US010421025B1

(12) United States Patent
Ward et al.

(10) Patent No.: US 10,421,025 B1
(45) Date of Patent: Sep. 24, 2019

(54) KIT OF PARTS FOR CHARACTER FIGURE

(71) Applicants: SPIN MASTER LTD., Toronto (CA); FUSE LONDON LTD, London (GB)

(72) Inventors: Mercedeh M. Ward, Torrance, CA (US); Oliver L. Pope, Hermosa Beach, CA (US); Mark A. Buckley, Tunbridge Wells (GB)

(73) Assignees: SPIN MASTER LTD., Toronto (CA); FUSE LONDON LTD, London (GB)

( * ) Notice: Subject to any disclaimer, the term of this patent is extended or adjusted under 35 U.S.C. 154(b) by 0 days.

(21) Appl. No.: 16/219,925

(22) Filed: Dec. 13, 2018

(51) Int. Cl.

| | |
|---|---|
| ***A63H 3/00*** | (2006.01) |
| ***A63H 3/16*** | (2006.01) |
| ***A63H 3/46*** | (2006.01) |
| ***A63H 3/36*** | (2006.01) |

(52) U.S. Cl.
CPC ..... *A63H 3/16* (2013.01); *A63H 3/365* (2013.01); *A63H 3/46* (2013.01)

(58) Field of Classification Search
CPC ..... A63H 3/003; A63H 3/006; A63H 5/00; A63H 3/16; A63H 3/365; A63H 3/46
USPC ... 446/97–99, 250, 268, 373, 375, 376, 380, 446/383, 381
See application file for complete search history.

(56) References Cited

U.S. PATENT DOCUMENTS 504,627 A 9/1893 Schultz
1,566,801 A * 12/1925 Millard ..... A63H 3/12 446/376
1,654,933 A * 1/1928 Heyman ..... A63H 3/46 446/381
2,606,398 A * 8/1952 Miller ..... A63H 9/00 264/305
2,944,368 A * 7/1960 O'Brian ..... A63H 3/08 446/100
3,277,602 A 10/1966 Speers et al.
4,297,153 A * 10/1981 Erickson ..... A63H 9/00 156/297
4,356,659 A * 11/1982 Clarke ..... A63H 3/40 446/97
6,227,930 B1 * 5/2001 Norman ..... A63H 3/52 2/243.1
6,478,653 B1 11/2002 Langton
6,537,131 B1 3/2003 Larian
6,568,986 B2 * 5/2003 Kobayashi ..... A63H 3/46 446/268
6,790,117 B2 * 9/2004 Ruiz Gonzalez ..... A63H 3/52 446/139

(Continued)

*Primary Examiner* — Nini F Legesse
(74) *Attorney, Agent, or Firm* — Millman IP Inc.

(57) ABSTRACT

In an aspect, a kit of parts is provided for assembling at least a portion of a character figure. The kit includes first and second kit member each having a body having a representation of a body portion of the character figure thereon. The first kit member has a hook extending outwardly from the body, and the second kit member body has a first hook-receiving aperture which has an interior surface that frictionally engages the exterior surface of the first hook, and is free of any bight pass-through members that engage the bight of the first hook to prevent removal of the first kit member from the second kit member. The kit members are joinable together to form at least a portion of a character figure. The bight of the first hook permits the first kit member to be hung on a first storage bar.

12 Claims, 5 Drawing Sheets

(56) References Cited

U.S. PATENT DOCUMENTS

| | | | | |
|---|---|---|---|---|
| 8,393,932 | B1 * | 3/2013 | Norman | A63H 3/36<br>446/385 |
| 9,861,903 | B1 * | 1/2018 | Mariasov | A63H 3/16 |
| 2004/0005838 | A1 * | 1/2004 | Buckley | A63H 3/16<br>446/99 |
| 2018/0099229 | A1 | 4/2018 | Simmons | |

* cited by examiner

KIT OF PARTS FOR CHARACTER FIGURE

FIELD

The specification relates generally to character figures. In particular, the following relates to kits of parts that permit assembly into a character figure.

BACKGROUND OF THE DISCLOSURE

It is known to provide character figures that are assemblable by a user (e.g. a child) from a kit of parts. However, in at least some examples, when such kits of parts are unassembled, they are difficult to store in an organized way. Additionally, it would be beneficial if a kit of parts for a character figure were provided that encouraged a child to learn some beneficial habit while playing therewith.

SUMMARY OF THE DISCLOSURE

In an aspect, there is provided a kit of parts for assembling at least a portion of a character figure. The kit of parts includes a first kit member that includes a first kit member body and a first hook extending outwardly therefrom. The first kit member body has a representation of a first body portion of the character figure thereon. The kit of parts further includes a second kit member that includes a second kit member body. The second kit member body has a representation of a second body portion of the character figure thereon and has a first hook-receiving aperture. The first hook has an exterior surface and a bight. The first hook-receiving aperture has an interior surface that frictionally engages the exterior surface of the first hook so as to removably receive and hold the first hook, and is free of any bight pass-through members that engage the bight of the first hook to prevent removal of the first kit member from the second kit member. The first and second kit members are joinable together by insertion of the first hook in the first hook-receiving aperture to form at least a portion of a character figure. The bight of the first hook is shaped to permit the first kit member to be hung on a first storage bar for storage.

BRIEF DESCRIPTIONS OF THE DRAWINGS

For a better understanding of the embodiments described herein and to show more clearly how they may be carried into effect, reference will now be made, by way of example only, to the accompanying drawings in which.

DETAILED DESCRIPTION

Figure 1:
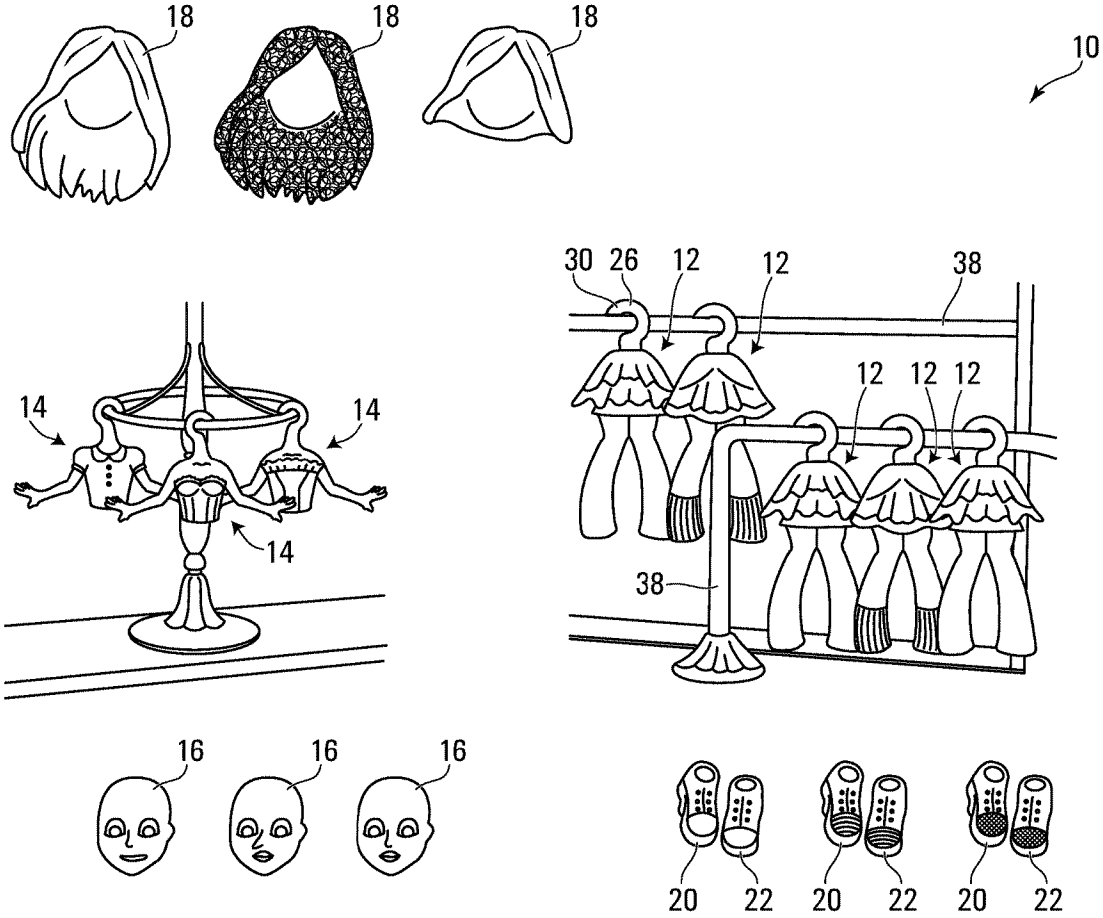
FIG. 1 shows a perspective view of a kit of parts for assembling into at least a portion of a character figure in accordance with an embodiment of the present disclosure.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Figure 3:
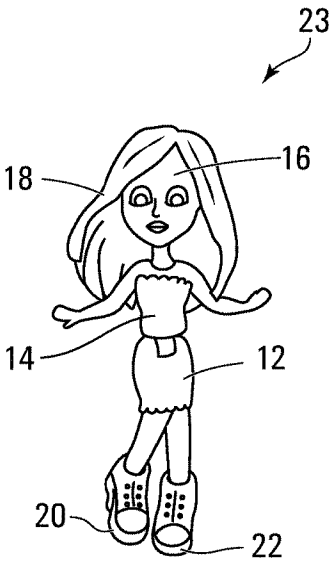
FIG. 3 is a perspective view of a character figure formed by joining the kit members shown in FIG. 2.

Reference is made to FIG. 1, which shows a kit of parts 10 in accordance with an embodiment of the present disclosure. The kit of parts 10 includes a plurality of first kit members 12, a plurality of second kit members 14, a plurality of third kit members 16, a plurality of fourth kit members 18, a plurality of fifth kit members 20, and a plurality of sixth kit members 22. The kit of parts 10 is for assembling at least a portion of a character figure, and preferably an entirety of a character figure. An example of such a character figure is shown in FIG. 3 at 23. The character FIG. 23 may be a figure of a person, as shown, or it may be a figure of an animal, a robot, a fictitious entity such as a dragon, or any other suitable type of character.

Figure 2:
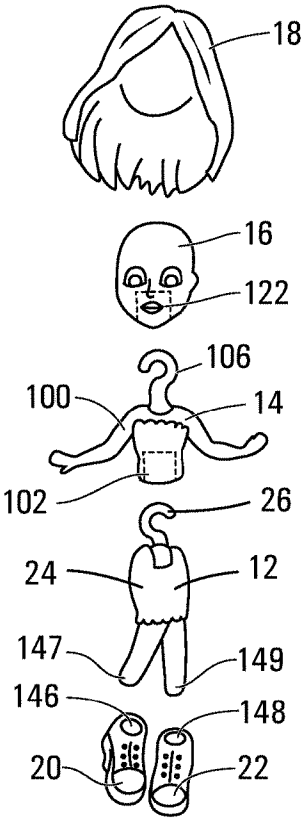
FIG. 2 is a perspective view of first, second, third, fourth, fifth and sixth kit members taken from the kit of parts shown in FIG. 1, that are joinable together.
Figure 5:
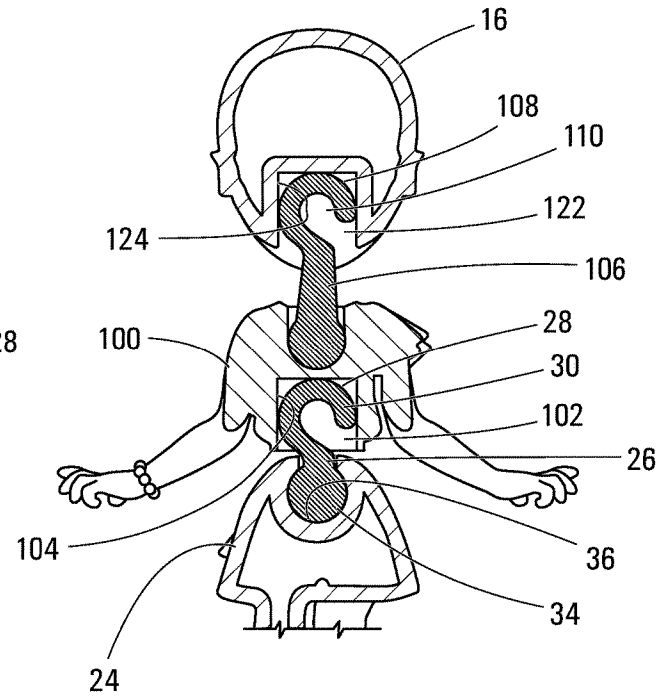
FIG. 5 is a sectional front elevation view of a portion of the character figure shown in FIG. 3.
Figure 4:
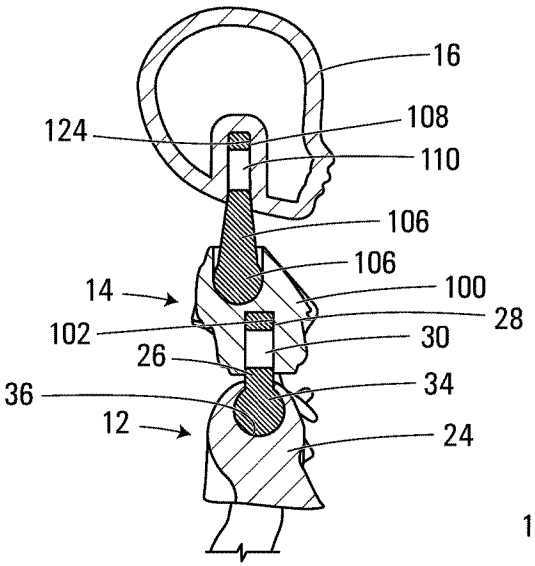
FIG. 4 is a sectional side elevation view of a portion of the character figure shown in FIG. 3.
Figure 6A:
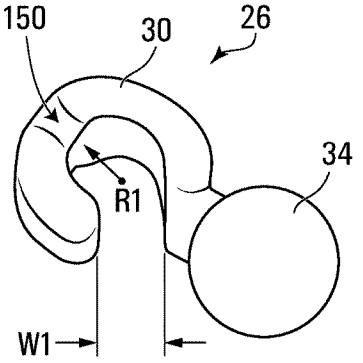
FIG. 6A is a perspective view of a first hook that is part of the first kit member shown in FIG. 2.
Figure 6B:
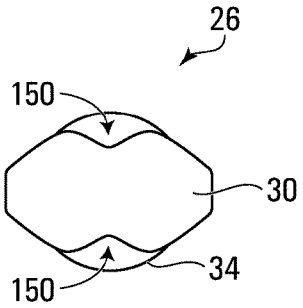
FIG. 6B is a top plan view of the first hook shown in FIG. 6A.

Each of the first kit members 12 includes a first kit member body 24 (FIG. 2) and a first hook 26 extending outwardly therefrom. The first kit member body 24 has a representation of a first body portion of the character FIG. 23 thereon. In the example shown in the figures, the representation of the first body portion of the character figure includes a representation of a lower torso and legs of the character FIG. 23. The first kit member body 24 may optionally also have a representation of a first portion of a clothing outfit thereon. In the example shown in FIG. 2, the first kit member body 24 has a representation of a lower portion of a dress. In some embodiments, however, it may have a representation of, for example, a skirt, a pair of pants, a pair of shorts, or any other suitable portion of a clothing outfit.

As can be seen in FIGS. 4, 5, 6A and 6B, the first hook 26 has an exterior surface 28, and has a bight 30. In some examples, the first hook 26 is pivotally connected to the first kit member body 24. The pivotal connection may be by any suitable structure. In the example shown, a pivotal connection is provided by means of a ball-and-socket connection. In the example shown, the ball-and-socket connection is provided by a ball 34 formed as part of the first hook 26, which is received in a socket 36 (FIGS. 4 and 5) that is formed as part of the first kit member body 24. It is alternatively possible to provide the ball 34 on the first kit member body 24 and the socket 36 on the first hook 26. The ball-and-socket connection permits the hook 26 to pivot about many axes and to swivel relative to the first kit member body 24.

The bight 30 of the first hook 26 is shaped to permit the first kit member 12 to be hung on a first storage bar 38 for storage as shown in FIG. 1. As can be seen in FIG. 1, a plurality of first storage bars 38 may be provided.

The second kit member 14 includes a second kit member body 100, which has a representation of a second body portion of the character figure thereon and has a first hook-receiving aperture 102 (FIGS. 4 and 5) therein. For example, the representation of the first body portion of the character figure may have a representation of an upper torso and a pair of arms of the character figure.

The second kit member body 102 may optionally also have a representation of a second portion of a clothing outfit thereon. In the example shown in FIG. 2, the second kit member body 24 has a representation of an upper portion of a dress. In some embodiments, however, it may have a representation of, for example, a blouse or any other suitable portion of a clothing outfit.

The first hook-receiving aperture 102 has an interior surface 104 that frictionally engages the exterior surface 28 of the first hook 26 so as to removably receive and hold the first hook 26, and is free of any bight pass-through members that engage the bight 30 of the first hook 26 to prevent removal of the first kit member 12 from the second kit member 14 (i.e. any members that would pass-through the bight 30 and that are sufficiently strong that they would prevent the first kit member 12 from being withdrawn from the second kit member 14 without unhooking the bight 30 from such a pass-through member). To further reinforce the above point, it can be seen that, to remove the first hook 26 from the first hook-receiving aperture 102, one only has to pull the first hook 26 outwards—it does not have to be unhooked from anything in the aperture 102. By contrast, the first storage bar 38 in FIG. 1 would constitute a bight pass-through member since the bight 30 would have to be unhooked from it in order to remove the first kit member 12 from the first storage bar 38.

The amount of frictional engagement between the first hook 26 and the first hook-receiving aperture 102 may be defined in some embodiments, as follows: the first kit member 12 has a weight and the first hook-receiving aperture 102 holds the first hook member 12 sufficiently tightly to prevent withdrawal of the first hook 26 from the first hook-receiving aperture 102 under the weight of the first kit member 12. Worded in a different way, the static friction force exerted between the first hook 26 and the first hook-receiving aperture 102 is sufficiently strong to prevent withdrawal of the first hook 26 from the first hook-receiving aperture 102 under the weight of the first kit member 12.

The first and second kit members 12 and 14 are joinable together by insertion of the first hook 26 in the first hook-receiving aperture 102 to form at least a portion of a character figure (e.g. the character FIG. 23 in FIG. 3). In this example the first and second kit members 12 and 14 form a portion of the character FIG. 23.

Because the first hook 26 is pivotally connected to the first kit member body 24, pivoting movement of the second kit member 14 relative to the first kit member 12 is permitted when the first hook 26 is held in the first hook-receiving aperture 102.

Providing the ball-and-socket connection permits movement of the second kit member 14 in at least two axes relative to the first kit member 12 when the first hook 26 is held in the first hook-receiving aperture 102.

The second kit member 14 has a second hook 106 extending outwardly from the second kit member body 100. The second hook 106 may be similar to the first hook 26 in the sense that the second hook 106 has an exterior surface 108 and has a bight 110 and may be connected to the second kit member body 100 in a similar manner to the connection between the first hook 26 and the first kit member body 24 (e.g. via a pivotal connection such as a ball-and-socket connection that permits pivoting of the third kit member 16 relative to the second kit member 14 in at least two axes and permits swiveling of the third kit member 16 relative to the second kit member 14).

The bight 110 of the second hook 106 may be the same shape as compared to the bight 30 of the first hook 26 and may therefore be shaped to permit the second kit member 14 to be hung on the first storage bar 38. Worded more specifically, the bight 30 of the first hook 26 has a first opening width W1 and may have a generally circular aperture shape with a first inner radius R1, and the bight 100 of the second hook 106 has a second opening width Ws that is the same width as the first opening width W1, and may have the same generally circular aperture shape, with a second inner radius that is the same size as the first inner radius.

Alternatively the bight 110 of the second hook 106 may have a different shape than the bight 30 of the first hook 26, such that the bight of one of the first and second hooks 26 or 106 would not fit on the same storage bar as the bight of the other of the first and second hooks 26 or 106.

The third kit member 16 includes a third kit member body 120 that has a representation of a third body portion of the character figure thereon. For example, the representation of the third body portion of the character figure may include a representation of a head of the character FIG. 23.

The third kit member body 120 has a second hook-receiving aperture 122, which has an interior surface 124 that frictionally engages the exterior surface 108 of the second hook 106 so as to removably receive and hold the second hook 106, and is free of any bight pass-through members that engage the bight 110 of the second hook 106 to prevent removal of the second kit member 14 from the third kit member 16. This is similar to the engagement between the first hook-receiving aperture 102 and the first hook 26.

The amount of frictional engagement between the second hook 106 and the second hook-receiving aperture 122 may be defined in some embodiments, as follows: the second kit member 14 has a weight and the second hook-receiving aperture 122 holds the second hook member 106 sufficiently tightly to prevent withdrawal of the second hook 106 from the second hook-receiving aperture 122 under the weight of the second kit member 14.

In the example shown, the plurality of fourth kit members 18 includes a plurality of hair pieces, which may fit via friction fit onto the third kit members 16. In other embodiments, the fourth kit members 18 could be provided with projections that are received into apertures in the third kit members 16.

In the example shown, the plurality of fifth kit members 20 includes a plurality of right feet and shoes for the character figure. These could optionally include hooks similar to the hooks 26 and 106, which could be inserted into hook-receiving apertures in the first kit members 14. In the present example however, the fifth kit members 20 include apertures 146 which receive the bottom 147 of the right leg represented on the first kit member body 24. The fifth kit members 20 may hold on to the bottom 147 of the right leg via friction fit therewith.

In the example shown, the plurality of sixth kit members 22 includes a plurality of left feet and shoes for the character figure. These could optionally include hooks similar to the hooks 26 and 106, which could be inserted into hook-receiving apertures in the first kit member 14. In the present example however, the sixth kit members 22 include apertures 148 149 which receive the bottom 149 of the left leg represented on the first kit member body 24. The sixth kit members 22 may hold on to the bottom of the left leg via friction fit therewith.

Figure 7:
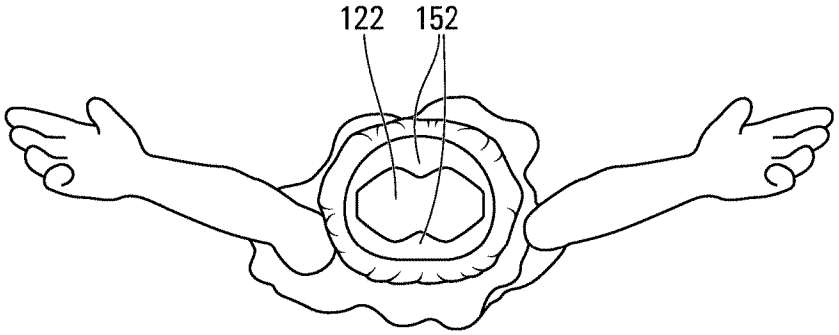
FIG. 7 is a bottom plan view of the second kit member shown in FIG. 2.
Figure 8A:
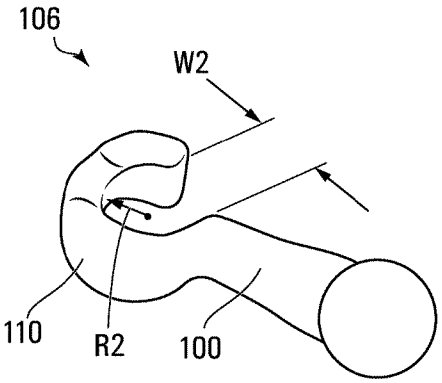
FIG. 8A is a perspective view of a second hook that is part of the second kit member shown in FIG. 2.
Figure 8B:
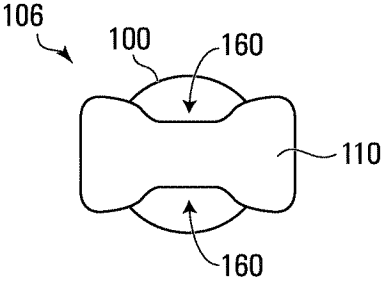
FIG. 8B is a top plan view of the second hook shown in FIG. 8A.
Figure 9:
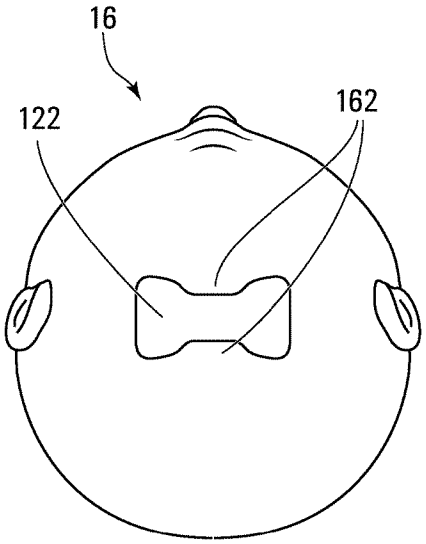
FIG. 9 is a bottom plan view of the third kit member shown in FIG. 2.

Optionally (and in the example shown in the figures), the first hook-receiving aperture 102 is shaped to receive the first hook 26, but not the second hook 106, and the second hook-receiving aperture 122 is shaped to receive the second hook 106 but not the first hook 26. For example, the first hook 26 shown in FIGS. 6A and 6B may have a pair of notches shown at 150, each of which has a depth and a width to fittingly mate with a pair of projections 152 on the first hook-receiving aperture 102 (FIG. 7) in the second kit member 14, and the second hook 106 shown in FIGS. 8A and 8B may have a pair of notches shown at 160, each of which has a depth and a width to fittingly mate with a pair of projections 162 on the second hook-receiving aperture 122 (FIG. 7) in the third kit member 14. Any other suitable way of configuring the first and second hooks 26 and 106 and the first and second hook-receiving apertures 102 and 122 such that first hook-receiving aperture 102 is shaped to receive the first hook 26, but not the second hook 106, and the second hook-receiving aperture 122 is shaped to receive the second hook 106 but not the first hook 26, may be provided. Alternatively, it is possible for the first and second hook-receiving apertures 102 and 122 to have the same shape (e.g. by omitting in the present example the notches 150 and 160 and the projections 160 and 162), and for the first hook receiving aperture 102 to be able to hold either of the first hook 26 and the second hook 106, and for the second hook receiving aperture 122 to be able to hold either of the first hook 26 and the second hook 106, thereby permitting the user to insert the first kit member 12 directly into the third kit member 16, for example, if desired.

By providing the first and second kit members 12 and 14 with the first and second hooks 26 and 106, the person (e.g. the child) that plays with the kit of parts 10 has an organized way of storing these items, similar to how clothing can be stored (i.e. by hanging the first and second kit members 12 and 14 up on a bar such as the storage bar 38). This can help to influence a child to hang up their own clothes, thereby keeping their room neater.

By providing the first and second hook-receiving apertures 102 and 122 that have interior surfaces that frictionally engage the exterior surfaces of the first and second hooks 26 and 106 so as to removably receive and hold the first and second hooks 26 and 106, and are free of any bight pass-through members that engage the bights of the first and second hooks 26 and 106, the hooks 26 and 106 are hidden when the character figure is assembled, and the first, second and third kit members 12, 14 and 16 can be assembled and disassembled easily, especially by a child.

Persons skilled in the art will appreciate that there are yet more alternative implementations and modifications possible, and that the above examples are only illustrations of one or more implementations. The scope, therefore, is only to be limited by the claims appended hereto and any amendments made thereto.

The invention claimed is:

1. A kit of parts for assembling at least a portion of a character figure, comprising:

a first kit member that includes a first kit member body and a first hook extending outwardly therefrom, wherein the first kit member body has a representation of a first body portion of the character figure thereon;

a second kit member that includes a second kit member body, wherein the second kit member body has a representation of a second body portion of the character figure thereon and has a first hook-receiving aperture, wherein the first hook has an exterior surface and a bight, and wherein the first hook-receiving aperture has an interior surface that frictionally engages the exterior surface of the first hook so as to removably receive and hold the first hook, and is free of any bight pass-through members that engage the bight of the first hook to prevent removal of the first kit member from the second kit member; and wherein the first and second kit members are joinable together by insertion of the first hook in the first hook-receiving aperture to form at least a portion of a character figure, and wherein the bight of the first hook is shaped to permit the first kit member to be hung on a first storage bar for storage.

2. A kit of parts as claimed in claim 1, wherein the second kit member has a second hook extending outwardly from the second kit member body, and wherein the kit of parts further comprises a third kit member that includes a third kit member body that has a representation of a third body portion of the character figure thereon and which has a second hook-receiving aperture, wherein the second hook has an exterior surface and a bight, and wherein the second hook-receiving aperture has an interior surface that frictionally engages the exterior surface of the second hook so as to removably receive and hold the second hook, and is free of any bight pass-through members that engage the bight of the second hook to prevent removal of the second kit member from the third kit member.

3. A kit of parts as claimed in claim 2, further comprising a storage arrangement that includes the first storage bar, and wherein the bight of the second hook is shaped to permit the second kit member to be hung on the first storage bar for storage.

4. A kit of parts as claimed in claim 1, wherein the first kit member body has a representation of a first portion of a clothing outfit thereon, and wherein the second kit member body has a representation of a second portion of the clothing outfit thereon.

5. A kit of parts as claimed in claim 1, wherein the first kit member has a weight and wherein the first hook-receiving aperture holds the first hook member sufficiently tightly to prevent withdrawal of the first hook from the first hook-receiving aperture under the weight of the first kit member.

6. A kit of parts as claimed in claim 1, wherein the representation of the first body portion of the character figure includes a representation of a pair of legs of the character figure, wherein the representation of the second body portion of the character figure includes a representation of an upper torso and a pair of arms of the character figure, and wherein the representation of the third body portion of the character figure includes a representation of a head of the character figure.

7. A kit of parts as claimed in claim 1, further comprising a storage arrangement that includes the first storage bar.

8. A kit of parts as claimed in claim 1, wherein the first hook has a bight having a first opening width and a generally circular inner aperture shape with a first inner radius, and wherein the second hook has a bight having a second opening width that is the same width as the first opening width, and wherein the second bight has a generally circular inner aperture shape that is the same generally circular inner shape of the bight of the first hook, which has a second inner radius that is the same size as the first inner radius.

9. A kit of parts as claimed in claim 1, wherein the first hook-receiving aperture is shaped to receive the first hook, but not the second hook, and wherein the second hook-receiving aperture is shaped to receive the second hook but not the first hook.

10. A kit of parts as claimed in claim 1, wherein the first kit member is one of a plurality of the first kit members, wherein the second kit member is one of a plurality of the second kit members.

11. A kit of parts as claimed in claim 1, wherein the first hook is pivotally connected to the first kit member body, so as to permit pivoting movement of the second kit member relative to the first kit member when the first hook is held in the first hook-receiving aperture.

12. A kit of parts as claimed in claim 1, wherein the first hook is connected to the first kit member body via a first ball-and-socket connection, so as to permit movement of the second kit member in at least two axes relative to the first kit member when the first hook is held in the first hook-receiving aperture.

* * * * *